US007341046B2

(12) United States Patent
Leymarie et al.

(10) Patent No.: US 7,341,046 B2
(45) **Date of Patent: *Mar. 11, 2008**

(54) IN-TANK FUEL DELIVERY ASSEMBLY WITH A PIVOTABLY MOUNTED EMISSIONS CANISTER

(75) Inventors: Pascal Leymarie, Châlons en Champagne (FR); Robert Renaud, Châlons en Champagne (FR)

(73) Assignee: TI Automotive Fuel Systems SAS, Châlons en Champagne (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/230,401

(22) Filed: Sep. 20, 2005

(65) Prior Publication Data

US 2006/0065247 A1 Mar. 30, 2006

(30) Foreign Application Priority Data

Sep. 28, 2004 (FR) ..... 04 10243

(51) Int. Cl.
*F02M 37/04* (2006.01)
*F02M 25/08* (2006.01)

(52) U.S. Cl. ..... 123/509; 123/519

(58) Field of Classification Search ..... 123/495, 123/509, 518, 519, 520, 516, 195 A; 137/565.34
See application file for complete search history.

(56) References Cited

U.S. PATENT DOCUMENTS 4,807,582 A 2/1989 Tuckey
5,398,656 A * 3/1995 Brisbane et al. ..... 123/470
5,522,425 A * 6/1996 Kroiss et al. ..... 137/590
6,000,913 A * 12/1999 Chung et al. ..... 417/53
6,029,633 A * 2/2000 Brandt ..... 123/509
6,158,975 A * 12/2000 Dill et al. ..... 123/509
6,302,144 B1 10/2001 Graham et al.
6,308,733 B2 10/2001 Murakoshi et al.
6,436,287 B1 * 8/2002 Fischerkeller et al. ..... 210/232
6,716,000 B2 * 4/2004 Appleton et al. ..... 417/360
6,941,808 B2 * 9/2005 Gouzou et al. ..... 73/313
6,966,305 B2 * 11/2005 Aubree et al. ..... 123/509
7,143,750 B2 * 12/2006 Brunel et al. ..... 123/509
2006/0065248 A1 * 3/2006 Leymarie et al. ..... 123/509

FOREIGN PATENT DOCUMENTS

FR 2771972 6/1999
WO WO 0225094 3/2002

* cited by examiner

*Primary Examiner*—Stephen K. Cronin
*Assistant Examiner*—Ka Chun Leung
(74) *Attorney, Agent, or Firm*—Reising, Ethington, Barnes, Kisselle, P.C.

(57) ABSTRACT

A fuel delivery assembly including a fuel pump module having a mounting flange and a reservoir housing carried by the mounting flange, and an emissions canister pivotally mounted to the reservoir housing of the fuel pump module, wherein the emissions canister is pivoted relative to the reservoir housing when the assembly is inserted through an access opening of a fuel tank and assembled thereto. Preferably, the assembly is positioned within the fuel tank so that respective bearing surfaces of the fuel pump module and emissions canister are in substantially the same plane against the bottom of the fuel tank, and a longitudinal axis of the emissions canister is approximately perpendicular to a longitudinal axis of the fuel pump module.

22 Claims, 3 Drawing Sheets

IN-TANK FUEL DELIVERY ASSEMBLY WITH A PIVOTABLY MOUNTED EMISSIONS CANISTER

Applicants claim priority of French Patent Application, Ser. No. 0410243, filed Sep. 28, 2004; and the present invention is related to pending U.S. patent application of Pascal Leymarie et al., Ser. No. 11/230,831, filed Sep. 20, 2005, entitled "FASTENER FOR AN IN-TANK FUEL DELIVERY ASSEMBLY", assigned to the assignee hereof and incorporated herein by reference.

FIELD OF THE INVENTION

This invention relates generally to fuel delivery systems for vehicles and, more particularly, to a fuel delivery assembly disposed in a vehicle fuel tank and including an accessory such as an emissions canister.

BACKGROUND OF THE INVENTION

For quite some time, fuel delivery systems for vehicles have typically included a fuel delivery assembly mounted within and received through an access opening in an upper wall of a fuel tank of a vehicle. A typical fuel delivery assembly may include a fuel pump module for delivering fuel from the fuel tank to the engine, a mounting flange for mounting to the upper wall of the fuel tank within the access opening, and a reservoir housing connected to the mounting flange. The reservoir housing may be of generally cylindrical shape, contains a predetermined volume of fuel therein regardless of normal changes in inclination of the vehicle, and houses an electric fuel pump therein with an intake port in communication with the interior of the reservoir housing. The fuel pump module is mounted to and within the fuel tank so that the bottom of the reservoir housing rests on the bottom of the fuel tank either directly or via supporting feet. The mounting flange may include various conduits that extend from the engine, through the mounting flange, and terminate in connections to various components of the fuel delivery assembly. The fuel pump module may also include a fuel level sender mounted to the reservoir housing and having a float and variable resistor to sense the level of fuel in the fuel tank.

More recently, fuel delivery assemblies may also include various accessories, such as a carbon canister for reducing evaporative emissions from a fuel tank. The carbon canister functions to limit emissions of fuel vapors from the fuel tank into the atmosphere. The carbon canister includes a housing containing activated carbon therein to trap fuel vapors therein and store the fuel vapors for subsequent release and combustion in the engine. The typical carbon canister is of generally cylindrical shape and may be carried by the mounting flange. The carbon canister includes conduits, which are connected between the canister housing to nipples on the mounting flange. Because fuel delivery assemblies with carbon canisters are often of relatively wider, longer, or of otherwise larger dimensions than typical fuel pump modules, it is usually necessary to enlarge the access opening of the fuel tank to accommodate installation of such fuel delivery assemblies therein.

Unfortunately, however, it is not always practical to adapt these fuel delivery assemblies for use with the larger access openings of existing fuel tank designs. More specifically, it is often unworkable to use existing designs of fuel delivery assemblies and fuel tanks because the access openings and height of existing fuel tanks are too small to accommodate these larger fuel delivery assemblies into canisters.

As disclosed in French patent application FR 2771972, a reservoir device for a fuel tank includes two reservoir housings; a "main" housing and an "auxiliary" housing connected together by linking means formed from plastic brackets. The two reservoir housings are ultimately positioned inside the fuel tank so that their respective bottoms are in contact with the bottom of the fuel tank. To this end, the auxiliary reservoir housing is first inserted via the access opening in the fuel tank by twisting the plastic brackets connecting the two reservoir housings, so that the plane of the bottom of the main reservoir housing and the plane of the bottom of the auxiliary reservoir housing form a mutual angle, the top of which is inclined toward the upper part of the fuel tank. When the auxiliary reservoir housing touches the bottom of the fuel tank at its lateral extremity opposite the main reservoir housing, the main reservoir housing is then partially engaged in the access opening of the fuel tank. Because the height of the auxiliary reservoir housing is relatively smaller than the height of the fuel tank, it is possible to then pivot the assembly, so as to maneuver the two reservoir housings into the desired position inside the fuel tank. Finally, pressure is exerted on the main reservoir housing, along the axis defined by the access opening, to untwist the plastic brackets in order to return them to their original position, and thus to place the two reservoir housings, side by side, on the bottom of the fuel tank.

But that solution is not practical when the length of the accessory inserted in the fuel tank is equal to or greater than the height of the fuel tank adjacent its access opening. In such a case, the accessory would become trapped when inserted and the entire fuel delivery assembly could not be disposed within the tank.

SUMMARY OF THE INVENTION

A fuel delivery assembly includes a fuel pump module having a mounting flange, a reservoir housing carried by the mounting flange, and an emissions canister pivotally mounted to the reservoir housing of the fuel pump module. The emissions canister is pivoted relative to the reservoir housing when the assembly is inserted through an access opening of a fuel tank and assembled thereto. Preferably, the assembly is ultimately positioned within the fuel tank so that respective bearing surfaces of the fuel pump module and emissions canister are in substantially the same plane against the bottom of the fuel tank, and preferably a longitudinal axis of the emissions canister is approximately perpendicular to a longitudinal axis of the fuel pump module.

According to a preferred aspect of the assembly, the fuel pump module is connected to the emissions canister by a hinge device that includes cooperating pivoting elements, which are pivotable about a pivot axis, wherein one of the pivoting elements is attached to the reservoir housing of the fuel pump module and the other to the emissions canister. According to another preferred aspect, locking elements between the fuel pump module and the emissions canister limit the pivoting of the hinge to an angle not exceeding 180°.

At least some of the objects, features and advantages that may be achieved by at least certain embodiments of the invention include providing a fuel delivery assembly that has a pivotable emissions canister but is readily assembled into a fuel tank; allows for assembly of an accessory having an overall length about equal to or greater than the height of the fuel tank adjacent its access opening; requires a relatively small access opening and may be used with existing fuel tank access opening sizes; delivers fuel from a fuel tank and reduces or prevents in-tank fuel vapors escaping to the atmosphere; is of relatively simple design and economical manufacture and assembly, rugged, durable, reliable and in service has a long useful life.

Of course, other objects, features and advantages will be apparent in view of this disclosure to those skilled in the art. Various other fuel delivery assemblies embodying the invention may achieve more or less than the noted objects, features or advantages.

BRIEF DESCRIPTION OF THE DRAWINGS

These and other objects, features and advantages of the present invention will be apparent from the following detailed description of the preferred embodiment and best mode, appended claims, and accompanying drawings in which:

DETAILED DESCRIPTION OF THE PREFERRED EMBODIMENTS

Figure 5A:
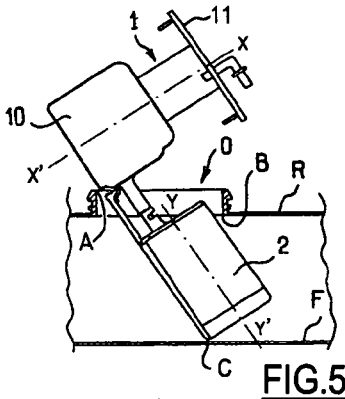
FIGS. 5A to 5F are elevational views of the fuel delivery assembly of FIG. 1 shown in successive stages of insertion into a fuel tank shown in cross section.
Figure 5B:
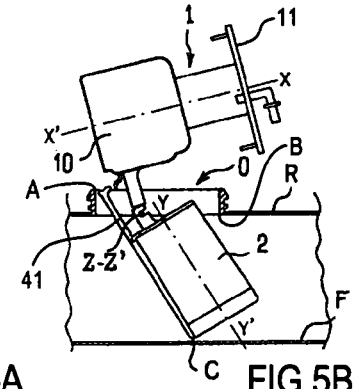
Figure 5C:
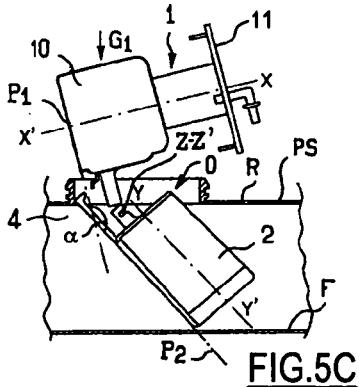
Figure 5D:
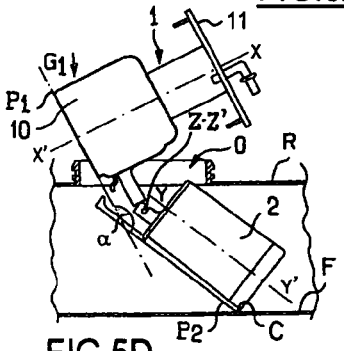
Figure 5E:
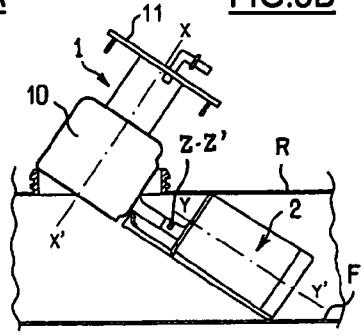
Figure 5F:
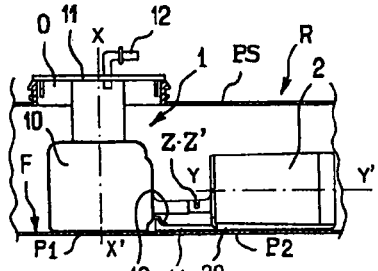

Referring in more detail to the drawings, FIG. 5F illustrates a fuel delivery assembly for delivering liquid and vaporous fuel from within a fuel tank R to an engine (not shown) of a vehicle (not shown). The fuel delivery assembly is configured to be introduced into the fuel tank R, and includes a fuel pump module 1 for delivering liquid fuel to the engine and an accessory 2 pivotally connected to the fuel pump module 1. Preferably, the accessory 2 is an emissions canister, such as a carbon canister, for trapping and storing fuel vapors for release to, and combustion within, the operating engine. Nonetheless, the accessory 2 may be any device suitable for use within a fuel tank.

Figure 1:
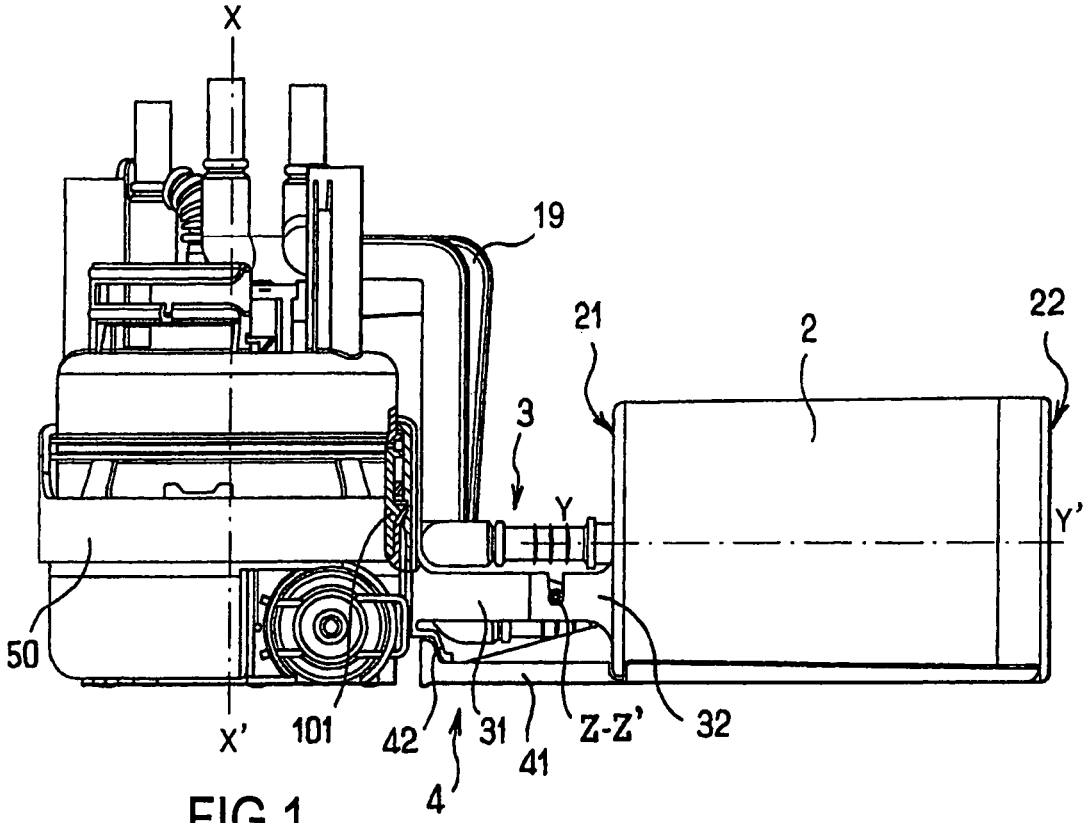
FIG. 1 is a partially-sectioned side view of a fuel delivery assembly including a fuel pump module and an emissions canister pivotably mounted to the fuel pump module.

Those of ordinary skill in the art will understand that, in the context of this present invention, the carbon canister 2 and the fuel pump module 1 can easily be connected together functionally by at least one, and preferably more appropriate flexible hoses, tubes or conduits 19 (as shown in FIG. 1), such as conventional annulated tubes, before introduction into the fuel tank R. The flexible tubes do not interfere with the relative movement between the carbon canister 2 and the fuel pump module 1 during insertion into the fuel tank R, thereby eliminating any later assembly operation to connect the carbon canister 2 and the fuel pump module 1, once they are in place in the fuel tank R.

The fuel pump module 1 includes a base or mounting flange 11 that mounts against the fuel tank R at an access opening O thereof, and a reservoir housing 10 carried by the mounting flange 11 in any suitable manner, wherein the reservoir housing 10 is configured to rest against a bottom F of the fuel tank R. More specifically the reservoir housing 10 has feet or a bearing surface that rests against the fuel tank bottom F, wherein the bearing surface is preferably circular in shape and/or has support feet formed thereon. Regardless of its shape, the bearing surface of the reservoir housing 10 extends in a plane P1 preferably substantially perpendicular to a longitudinal axis X-X' of the fuel pump module 1.

The carbon canister 2 is of generally cylindrical shape, and is located on the bottom F of the fuel tank R so that its longitudinal axis Y-Y' is preferably substantially perpendicular to the longitudinal axis X-X' of the fuel pump module 1 and preferably substantially parallel to the bottom F of the fuel tank R. The carbon canister 2 rests on the bottom F of the fuel tank R by means of a flat area bearing surface on its outer surface or by way of a support 20, of small thickness. The bearing surface of the carbon canister 2 extends along the bottom F of the fuel tank R in a plane P2 preferably substantially parallel to the longitudinal axis Y-Y' of the carbon canister 2. When the fuel pump module 1 and the carbon canister 2 are positioned on the bottom F of the fuel tank R, their respective bearing surfaces are preferably substantially in the same plane. In other words, planes P1 and P2 are preferably coincident.

As shown in FIG. 1, the carbon canister 2 has two approximately circular opposite ends; a "proximal" end 21 located close to and facing the fuel pump module 1, and a "distal" end 22 substantially opposite the proximal end 21. Moreover, the fuel pump module 1 and the carbon canister 2 are connected together preferably by a "knuckle" type of hinge that allows pivoting of two parts about an axis of rotation, preferably to a maximum angle of 180°. The knuckle-type hinge includes a hinge device 3, and locking elements 4 that provide a configuration limiting angular or pivotal movement between the fuel pump module 1 and the accessory 2.

Figure 2:
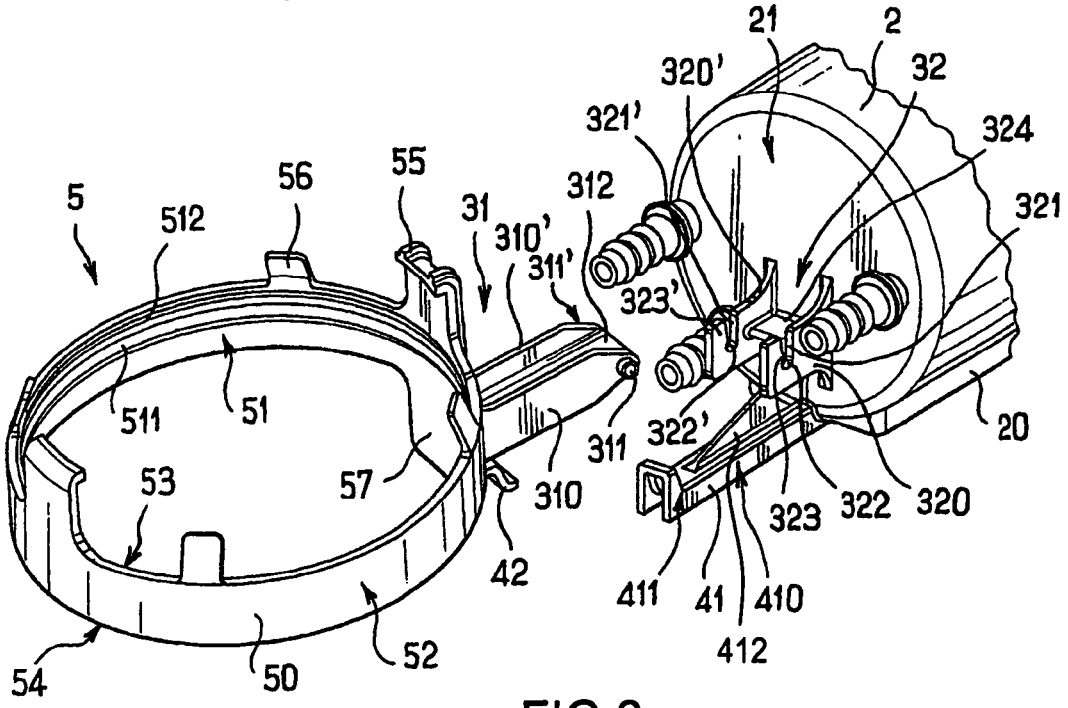
FIG. 2 is a perspective view of a portion of the fuel pump module and the emissions canister of FIG. 1.

Referring to FIG. 2, the hinge device 3 is preferably composed of plastic and includes two pivoting elements 31, 32 which may be integrally or separately attached to the fuel pump module 1 and to the carbon canister 2. The pivoting element 31 may be integrally attached with the external wall of the reservoir housing 10 of the fuel pump module 1 as shown in FIGS. 5A through 5F or, as shown in FIGS. 1 through 4, may be separately attached to a support 5 which may be connected to the pump module. The pivoting element 31 includes two parallel plates or sides 310, 310', which are connected together by a perpendicular wing or web 312, so that in transverse cross section the pivoting element 31 has an "H" shape. At the free end of the pivoting element 31, two lugs or pins 311, 311' project perpendicularly from respective outer surfaces of the two parallel sides 310, 310'. Only one lug 311 is visible in the figures, but both lugs 311, 311' determine the axis of rotation Z-Z' of the hinge device 3, which axis is preferably substantially perpendicular to the aforementioned axes X-X' and Y-Y'.

The pivoting element 32 may be integrally or separately attached to the emissions canister 2, and includes two parallel plates or sides 320, 320', each of which has an oblong notch 321, 321' open at the top thereof. The two sides 320, 320' are connected together by a wing or web 324 which is perpendicular to the sides 320, 320'. The notches 321, 321' are intended to receive the lugs 311, 311' of the other pivoting element 31. Preferably, the bottom of each notch 321, 321' has a rounded part 322, 322' intended to receive the lugs 311, 311' of the pivoting element 31, and one of the edges of each notch 321, 321' is slightly inclined outwards and upwards, so as to form a projection 323, 323'. In the notches 321, 321', the projections 323, 323' define a reduced width portion that is smaller than the diameter of the rounded part 322, 322' and the pins or lugs 311, 311'. Such an arrangement is used to retain the lugs 311, 311' inside the notches 321, 321' by a detent or snap-fit effect. The two elements 31, 32 of the hinge device 3 and, thus, the fuel pump module 1 and/or carbon canister 2, can thereby pivot about the pivot axis Z-Z'.

Referring to FIG. 2, the support 5 is preferably composed of plastic and includes a cylindrical support ring 50, of low width or height, whose inside diameter is only slightly greater than that of the reservoir housing 10 of the fuel pump module 1. The cylindrical ring 50 includes an internal wall or surface 51, wherein an annular rib 511 extends therefrom and an annular groove 512 is formed therein. As best shown in the sectioned portion of FIG. 1, the annular rib 511 and groove 512 are designed to fit with a corresponding annular rib 101 formed on the external wall of the reservoir housing 10, so as to attach the ring 50 around the reservoir housing 10 by a detent or snap-fit effect.

As shown in FIG. 2, the ring 50 is preferably equipped with several brackets 55 and tabs 56, respectively two and four in number, which extend from an upper edge 53 of the ring 50. These brackets 55 and tabs 56 fit onto the reservoir housing 10, in order to ensure axial and angular positioning of the ring 50 and to prevent unwanted movement between the ring 50 and the housing 10. The pivoting element 31 of the hinge device 3 is preferably integrally formed with the ring 50. Accordingly, the ring 50 has a generally downwardly extending strip of material 57 that extends axially from a lower edge 54 of the ring 50 opposite one of the brackets 55. The pivoting element 31 extends radially outwards from this strip of material 57.

Figure 3:
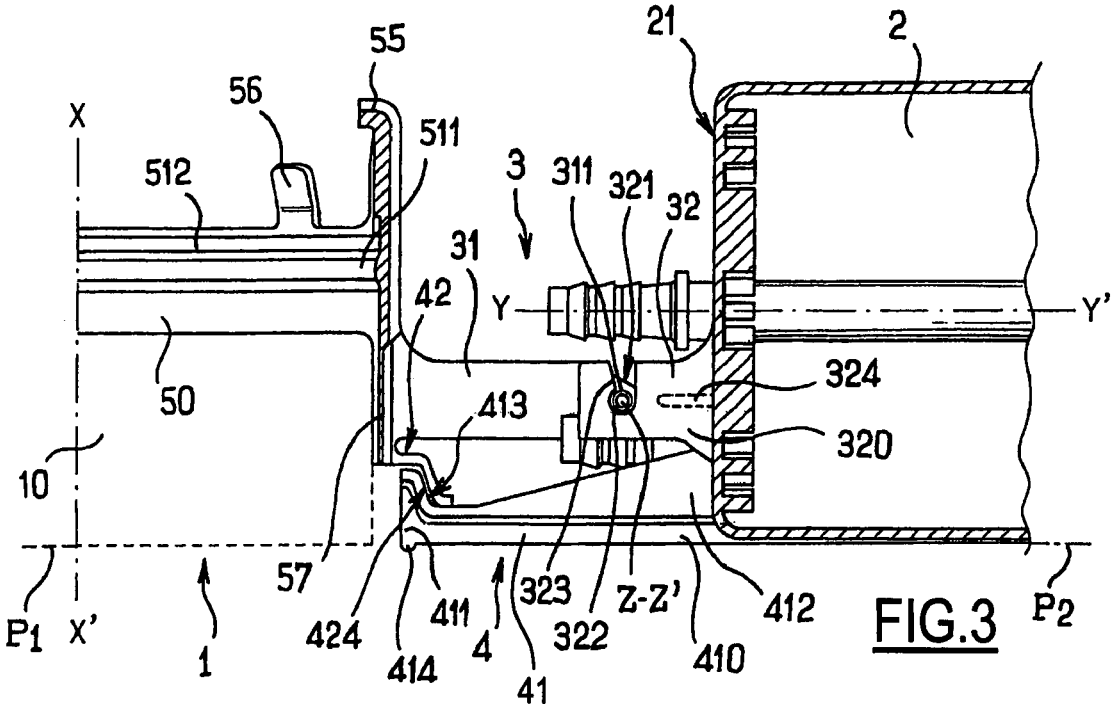
FIG. 3 is a cross-sectional side view of a portion of the fuel delivery assembly of FIG. 1 wherein the assembly is at rest in the normal position it assumes in the fuel tank.
Figure 4:
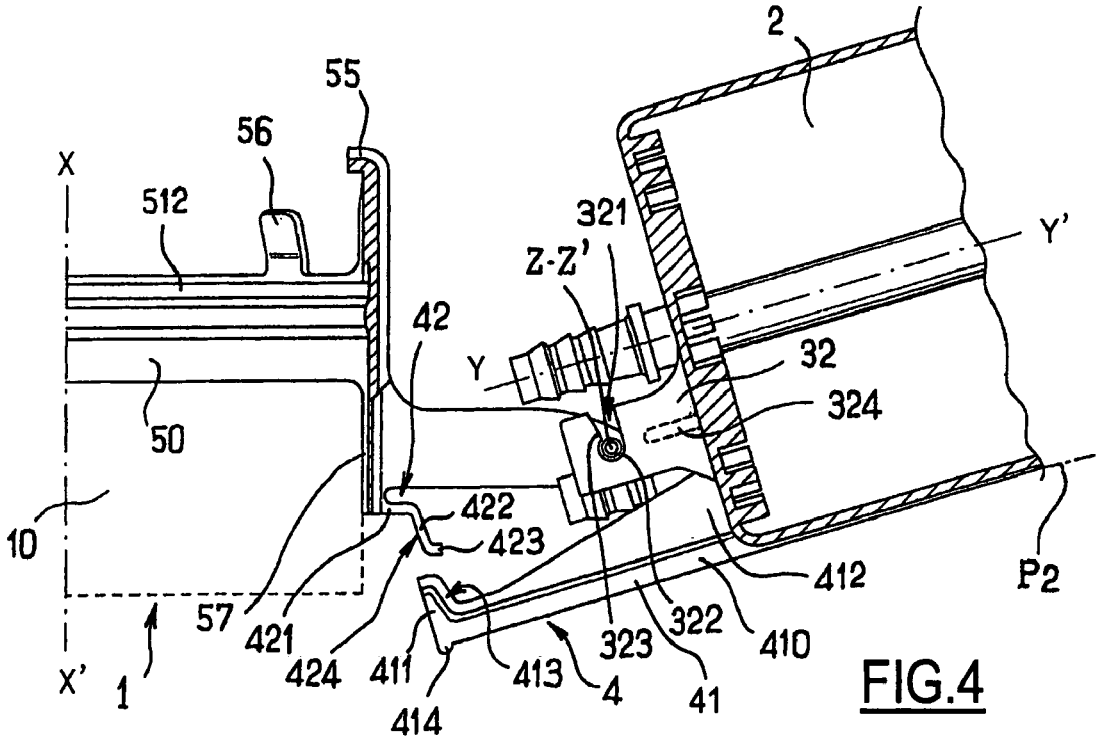
FIG. 4 is a cross-sectional side view of a portion of the fuel delivery assembly of FIG. 1 wherein the assembly is being pivoted.

As best shown in FIGS. 3 and 4, the locking elements 4 include a locking bracket 41 integral with or attached to the support 20 or carbon canister 2, and a locating or locking tab 42 integral with or attached to the support 5. In vertical section along a plane passing through axis Y-Y', the locking bracket 41 has the general shape of an "L" whose horizontal branch 410 is relatively longer than its vertical branch 411. The horizontal branch 410 is preferably integral with the proximal wall 21 of the carbon canister 2 perpendicular to axis Y-Y', and extends generally perpendicular to the plane of the wall 21. A generally parallel triangular-shaped stiffening rib 412 of the bracket 41 extends between the proximal wall 21 and the branch 410. The branch 411 is tapered in the direction of its free end, so that its face, located facing the proximal wall 21 of the carbon canister 2, is slightly inclined and constitutes a contact surface 413.

The locking tab 42 may be integrally formed with the ring 50 of the support 5 such as by molding it with the strip of material 57 to extend under the hinge element 31. The locking tab 42 includes a horizontal portion 421 extending from the strip 57 perpendicular to axis X-X', a generally vertical portion 422 which is inclined downward and outward, and an end portion 423 generally parallel to horizontal portion 421. A rear face of the vertical portion 422 is oriented downward and constitutes a contact surface 424 that is arranged for engagement with the locking bracket contact surface 413.

When the fuel pump module 1 and the carbon canister 2 are positioned at the bottom of the fuel tank R, in the installed position illustrated in FIG. 3, the web 411 of the locking bracket 41 preferably takes a position against the locking tab 42, so that its contact surface 413 butts up against or engages the contact surface 424 of the locking tab 42. In addition, the locking bracket 41 has a lug 414 forming an end-stop on the lower face of the branch 410, at the base of the branch 411. As shown in FIG. 3, when the assembly is at rest on the bottom of the fuel tank such that the Y-Y' axis is substantially perpendicular to the X' axis, the end-stop 414 preferably is located on the bottom of the fuel tank to yieldably bias the locking bracket 41 in an upward direction into engagement with the locking tab 42. Moreover, due to the inherent elasticity and configuration of the locking tab 42, the locking tab 42 is yieldably biased into engagement with the locking bracket 41, tending to keep the two contact surfaces 413 and 424 engaged against one other.

The lengths of the pivoting elements 31 and 32 of the hinge device 3 are such that the pivoting axis Z-Z' is sufficiently spaced apart from the side wall of the reservoir housing 10 and from the proximal wall 21 of the carbon canister 2, to allow sufficient pivoting of the carbon canister 2 relative to the fuel pump module 1, for inserting them into the fuel tank R without hindrance.

FIGS. 5A through 5F illustrate insertion of the fuel delivery assembly into the fuel tank R. In FIG. 5A, the assembly is shown in an engaged or latched condition wherein the carbon canister 2 is in a pivotably restrained or limited condition relative to the fuel pump module 1. To insert the pivotably restrained assembly into the fuel tank R, an assembler first introduces the carbon canister 2 through the access opening O of the fuel tank R, preferably until a lower portion of its distal wall 22 comes into contact with the bottom F of the fuel tank R at contact point C, and the bottom of the reservoir housing 10 comes into contact with the edge of the opening O, at contact point A. The carbon canister 2 may touch the opening O of the fuel tank at B, which is at a point diametrically opposite to point A.

As shown in FIG. 5B, the assembler then pivots the fuel pump module 1 about the pivot axis Z-Z' of the hinge device 3, so as to disengage or unlock the stop elements 4 such that the bottom of the reservoir housing 10 is no longer touching the edge of the opening O. The assembler then continues inserting the carbon canister 2 into the fuel tank R. The locking bracket 41 slides along the opening O while the upper part of the carbon canister 2 no longer touches the upper wall PS of the fuel tank R, at B.

This movement is continued, as illustrated in FIGS. 5C and 5D, while also exerting a downward pressure on the fuel pump module 1 in the direction of arrow G to also insert the fuel pump module 1 into the fuel tank R. In this position, the plane P1 of the bearing surface of the fuel pump module 1 and the plane P2 of the bearing surface of the carbon canister 2 form a mutual included angle a of less than 180°, the apex of which is oriented toward the lower part of the fuel tank R, that is opposite to the access opening O.

Referring to FIG. 5E, the assembler again pivots the fuel pump module 1 about pivot axis Z-Z', this time in the opposite direction toward an engaged or pivotal stop condition of the assembly, with planes P1 and P2 now preferably substantially parallel.

Finally, referring to FIG. 5F, the assembler then completes the insertion of the fuel pump module 1 into the fuel tank R until its mounting flange 11 rests on the edge of the opening O. In the latter position, planes P1 and P2 are preferably substantially parallel and preferably coincident, and the carbon canister 2 is in engaged or pivotally stopped relation to the fuel pump module 1. Preferably, in this position, the locking tab 42 is at least slightly stressed elastically by the locking bracket 41.

According to other implementations not shown in the figures, the locking elements 4 could be omitted and the hinge device 3 could be designed to directly incorporate means to limit its pivoting action to a maximum angle of about 180°. Furthermore, the locking bracket 41 could instead be attached to the fuel pump module 1 and the locking tab 42 could instead be attached to the carbon canister 2.

As used in this specification and claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other, additional components, elements, or items. Moreover, directional words such as top, bottom, upper, lower, radial, circumferential, axial, lateral, longitudinal, vertical, horizontal, and the like are employed by way of description and not limitation. Other terms are to be construed using their broadest reasonable meaning unless they are used in a context that requires a different interpretation. When introducing elements of the present invention or the embodiments thereof, the articles "a," "an," "the," and "said" are intended to mean that there are one or more of the elements.

It is to be understood that the invention is not limited to the particular exemplary embodiments disclosed herein, but rather is defined by the claims below. In other words, the statements contained in the foregoing description relate to particular exemplary embodiments and are not to be construed as limitations on the scope of the invention as claimed below or on the definition of terms used in the claims, except where a term or phrase is expressly defined above.

Although the present invention has been disclosed in conjunction with a presently preferred exemplary embodiment, many others are possible and it is not intended herein to mention all of the possible equivalent forms and ramifications of the present invention. Other modifications, variations, forms, ramifications, substitutions, and/or equivalents will become apparent or readily suggest themselves to persons of ordinary skill in the art in view of the foregoing description. In other words, the teachings of the present invention encompass many reasonable substitutions or equivalents of limitations recited in the following claims. As just one example, the disclosed structure, materials, sizes, shapes, and the like could be readily modified or substituted with other similar structure, materials, sizes, shapes, and the like. Indeed, the present invention is intended to embrace all such forms, ramifications, modifications, variations, substitutions, and/or equivalents as fall within the spirit and broad scope of the following claims.

What is claimed is:

1. A fuel delivery assembly for insertion into a fuel tank of a vehicle, comprising:

a fuel pump module including a mounting flange and a reservoir housing carried by the mounting flange;

an accessory pivotally mounted to the reservoir housing of the fuel pump module about a pivot axis to enable the assembly to be positioned in the fuel tank; and locking elements between the fuel pump module and the accessory which engage to limit pivotal movement between the reservoir housing and the accessory during insertion into the fuel tank to a mutually included angle of not greater than 180° and when installed in the fuel tank engage to limit pivotal movement in at least one direction of the accessory relative to the reservoir when the assembly is in an installed position.

2. A fuel delivery assembly for insertion into a fuel tank of a vehicle, comprising:

a fuel pump module including a mounting flange and a reservoir housing carried by the mounting flange;

an accessory pivotally mounted to the reservoir housing of the fuel pump module about a pivot axis to enable the assembly to be positioned in the fuel tank so that respective bearing surfaces of the fuel pump module and accessory rest against the bottom of the fuel tank in substantially parallel planes; and locking elements between the fuel pump module and the accessory which engage to limit pivotal movement between the reservoir housing and the accessory during insertion into the fuel tank to a mutually included angle of not greater than 180° and when installed in the fuel tank engage to limit pivotal movement in at least one direction of the accessory relative to the reservoir.

3. The fuel delivery assembly of claim 1, wherein the accessory is an emissions canister for trapping fuel vapors therein.

4. The fuel pump assembly of claim 1, further comprising at least one flexible conduit connected between the fuel pump module and the accessory.

5. A fuel delivery assembly for insertion into a fuel tank of a vehicle, comprising:

a fuel pump module including a mounting flange and a reservoir housing carried by the mounting flange;

accessory pivotally mounted to the reservoir housing of the fuel pump module;

at least one flexible conduit extending between the accessory and the fuel pump module;

a hinge between the fuel pump module and the accessory to enable the assembly to be positioned in the fuel tank so that respective bearing surfaces of the fuel pump module and accessory rest against the bottom of the fuel tank substantially along parallel planes; and locking elements between the fuel pump module and the accessory which engage to limit pivotal movement between the reservoir housing and the accessory during insertion into the fuel tank to a mutually included angle of not greater than 180° and when installed in the fuel tank engage to limit pivotal movement in at least one direction of the accessory relative to the reservoir.

6. The fuel delivery assembly of claim 5, wherein the accessory is a carbon canister for trapping fuel vapors therein.

7. A fuel delivery assembly for insertion into a fuel tank of a vehicle, comprising:

a fuel pump module including a mounting flange and a reservoir housing carried by the mounting flange;

an emissions canister pivotally mounted to the reservoir housing of the fuel pump module; and a hinge including a first pivoting element attached to the fuel pump module and a second pivoting element attached to the emissions canister wherein the pivoting elements are pivotable about a pivot axis to enable the assembly to be positioned in the fuel tank so that respective bearing surfaces of the fuel pump module and emissions canister rest against the bottom of the fuel tank substantially along the same plane.

8. The fuel delivery assembly of claim 7, further comprising a first locking element associated with the fuel pump module and a second locking element associated with the emissions canister wherein the locking elements are engageable to limit pivoting of the hinge to an angle not exceeding 180°.

9. The fuel delivery assembly of claim 8, wherein the first locking element includes a locking tab attached to the fuel pump module and a locking bracket attached to the emissions canister, wherein the bracket and the tab engage one another when respective bearing surfaces of the fuel pump module and of the emissions canister are in the same plane.

10. The fuel delivery assembly claim 9 wherein the locking tab is attached to a support attached around the reservoir housing of the fuel pump module.

11. The fuel delivery assembly of claim 9, wherein the locking bracket is L-shaped.

12. The fuel delivery assembly of claim 11, wherein the locking bracket includes a free end having a contact surface and the locking tab includes a contact surface complementary to the contact surface of the locking bracket.

13. A fuel delivery assembly for insertion into a fuel tank of a vehicle, comprising:

a fuel pump module including a mounting flange and a reservoir housing carried by the mounting flange;

an emissions canister pivotally mounted to the reservoir housing of the fuel pump module;

at least one flexible conduit extending between the emissions canister and the fuel pump module; and a hinge including a first pivoting element attached to the fuel pump module and a second pivoting element attached to the emissions canister wherein the pivoting elements are pivotable about a pivot axis to enable the assembly to be positioned in the fuel tank so that respective bearing surfaces of the fuel pump module and emissions canister rest against the bottom of the fuel tank substantially along the same plane.

14. The fuel delivery assembly of claim 13, wherein the first pivoting element of the hinge is connected to a support attached around the reservoir housing of the fuel pump module.

15. The fuel delivery assembly of claim 14, wherein one of the pivoting elements includes two sides equipped with open notches, and wherein the other of the pivoting elements includes two lugs capable of engaging in the notches.

16. The fuel delivery assembly of claim 13, further comprising a first locking element associated with the fuel pump module and a second locking element associated with the emissions canister wherein the locking elements are engageable to limit pivoting of the hinge to an angle not exceeding 180°.

17. The fuel delivery assembly of claim 16, wherein the first locking element includes a locking tab attached to the fuel pump module and a locking bracket attached to the emissions canister, wherein the bracket and the tab engage one another when respective bearing surfaces of the fuel pump module and of the emissions canister are substantially in the same plane.

18. A fuel delivery assembly for insertion into a fuel tank of a vehicle, comprising:

a fuel pump module including a mounting flange and a reservoir housing carried by the mounting flange;

an emissions canister pivotally mounted to the reservoir housing of the fuel pump module; and a hinge including a first pivoting element attached to the fuel pump module and a second pivoting element attached to the emissions canister wherein the pivoting elements are pivotable about a pivot axis to enable the assembly to be positioned in the fuel tank so that respective bearing surfaces of the fuel pump module and emissions canister rest against the bottom of the fuel tank substantially along the same plane, wherein the first pivoting element of the hinge is connected to a support attached around the reservoir housing of the fuel pump module.

19. The fuel delivery assembly of claim 18, wherein one of the pivoting elements includes two sides equipped with open notches, and wherein the other of the pivoting elements includes two lugs capable of engaging in the notches.

20. A fuel delivery assembly for insertion into a fuel tank of a vehicle, comprising:

a fuel pump module including a mounting flange and a reservoir housing carried by the mounting flange;

a support ring carried by the reservoir housing and including a first pivoting element and a first locking element;

a carbon canister pivotally mounted to the reservoir housing of the fuel pump module via the support ring and including a second pivoting element and a second locking element; and at least one flexible conduit extending between the carbon canister and the fuel pump module;

wherein the pivoting elements are pivotable about a pivot axis to enable the assembly to be positioned in the fuel tank so that respective bearing surfaces of the fuel pump module and carbon canister rest against the bottom of the fuel tank substantially along the same plane, and further wherein the locking elements are engageable to limit pivoting of the carbon canister relative to the fuel pump module to an angle not exceeding 180°.

21. The fuel delivery assembly of claim 20, wherein one of the pivoting elements includes two sides equipped with open notches, and wherein the other of the pivoting elements includes two lugs capable of engaging in the notches, further wherein the first locking element includes a locking tab on the support ring and a locking bracket connected to the carbon canister, wherein the bracket and the tab engage one another when respective bearing surfaces of the fuel pump module and of the carbon canister are in the same plane.

22. The fuel delivery assembly of claim 20, wherein the overall length of the fuel pump module and carbon canister is greater than the height of the fuel tank adjacent the access opening the fuel tank through which the fuel delivery assembly is inserted.

* * * * *